United States Patent [19]

Takahashi

[11] Patent Number: 4,690,022

[45] Date of Patent: Sep. 1, 1987

[54] STAMPING DEVICE HAVING IDENTICAL MOUNT BASES FOR ROTATABLY SUPPORTING A CUTTING TOOL AND AN ANVIL

[75] Inventor: Takehiro Takahashi, Mihara, Japan

[73] Assignee: Mitsubishi Jukogyo Kabushiki Kaisha, Tokyo, Japan

[21] Appl. No.: 753,965

[22] Filed: Jul. 11, 1985

[51] Int. Cl.[4] ..... B26D 1/36; B31B 1/24

[52] U.S. Cl. ..... 83/308; 83/347; 83/700; 493/367; 493/370; 493/471

[58] Field of Search ..... 493/471, 370, 367, 368, 493/472, 475, 478, 479; 83/659, 669, 670, 308, 346, 347, 700, 499

[56] References Cited

U.S. PATENT DOCUMENTS

| | | | |
|---|---|---|---|
| 3,064,513 | 11/1962 | Hershey | 83/700 |
| 3,119,312 | 1/1964 | Henc | 493/471 |
| 3,143,022 | 8/1964 | Andersen | 83/670 |
| 3,318,206 | 5/1967 | Kuehn et al. | 493/403 |
| 3,577,822 | 5/1971 | Sauer | 83/659 |
| 4,069,749 | 1/1978 | Olsen et al. | 493/471 |
| 4,095,511 | 6/1978 | Woolston | 83/499 |
| 4,113,243 | 9/1978 | Gregoire et al. | 493/471 |
| 4,548,113 | 10/1985 | Topperwien et al. | 83/670 |

*Primary Examiner*—Frederick R. Schmidt
*Assistant Examiner*—William E. Terrell
*Attorney, Agent, or Firm*—Wenderoth, Lind & Ponack

[57] ABSTRACT

A stamping device for cutting holes in paper sheets such as corrugated cardboard including a pair of identically shaped one-piece mount bases each of which is slidably mounted on and fixed to a rotatable upper and lower shaft for rotation therewith, each of the mount bases having a slot therein for engaging a yoke plate to adjust the position of the mount bases along a respective shaft. An anvil is slidably disposed on one of the mount bases with the anvil being freely rotatable with respect to the mount base. A knife base is slidably disposed on the other mount base and is keyed to the other mount base for rotation therewith, the knife base having a cutting tool disposed thereon for cutting holes in the paper sheet. A pair of identically shaped retaining plates are fixed to each of the mount bases with one of the retaining plates engaging the anvil for positioning the anvil on one of the mount bases and the other retaining plate engaging the knife base for positioning the knife base on the other mount base.

7 Claims, 8 Drawing Figures

STAMPING DEVICE HAVING IDENTICAL MOUNT BASES FOR ROTATABLY SUPPORTING A CUTTING TOOL AND AN ANVIL

BACKGROUND OF THE INVENTION

The present invention relates to a stamping device that is applicable to a box-making machine.

Outline of a corrugated cardboard box-making machine of the prior art having devices for cutting hand-holes or air holes in cardboard sheets is shown in FIG. 1. In the figure, reference character a designates a paper sheet feed section, reference characters b and c designate print sections and reference character d designates a paper sheet eject section. One example of a hand-hole cutting device of the prior art which may be provided, if necessary, in this cardboard eject section d, is illustrated in FIGS. 2 to 4 (Since an air-hole cutting device employs a similar system to the hand-hole cutting device, description of the air-hole cutting device will be omitted.). FIG. 2 is a perspective view, FIG. 3 is a side view, FIG. 4 is a view taken along line A—A in FIG. 3 as viewed in the direction of arrows, and FIG. 5 is a plan view of a corrugated cardboard sheet that has been processed by the corrugated cardboard box-making machine.

Slot cutting designated by reference character e in FIG. 5 is carried out when the sheet passes between shaft j in the section d in FIG. 1, hand-hole cutting designated by reference character f in FIG. 5 is carried out likewise when the sheet passes between the shaft j in the section d in FIG. 1, and fold line working (scoring) designated by reference character g in FIG. 5 is carried out when the sheet passes between shafts k and between shafts 1 in the section d in FIG. 1. In addition, reference character h designates a fold line (score) worked by another kind of machine in the preceding step of the process. In FIG. 1, a corrugated cardboard sheet m fed from the paper sheet feed section a passes through the print sections b and c (with regard to the printing, detailed description will be omitted), and when it passes between the shafts k and between the shafts 1 in the paper sheet eject section d, scoring as shown at g in FIG. 5 is carried out.

Furthermore, when it passes between the shafts j, slot cutting as shown at e in FIG. 5 is carried out, and at the same time, hand-holes as shown at f in FIG. 5 are cut by means of a hand-hole die cutting device p shown in FIGS. 2 and 3 which is provided on the same shafts and which is the subject matter of the present invention. Regarding the working devices (not shown) for the slots e, normally the respective slot cutting devices are preset for each given dimension of the box-making by push-button operations through the respective electromechanical systems. However, with regard to the hand-hole die cutting device p, it is necessary to manually carry out mounting, demounting and position setting of the device on the shafts j for each hand-hole to be cut, as shown in FIGS. 3 and 4.

Briefly describing the operations, the shafts j have a mechanism such that they may be rotated in timed synchronism with the sheet m when it passes between them. A knife r mounted on a split knife mount base q and a split anvil t mounted on an anvil mount base s are respectively clamped on shafts u and v by means of fastening bolts w. Thus, the sheet m passing between the anvil t and the knife r can be stamped or die cut with the shape and dimension of the knife r which has been preliminarily shaped into a predetermined dimension. Here, it is to be noted that the stamping or die cutting method (normally called "upside stamping or die cutting method" or "downside stamping or die cutting method" depending upon whether the mount position of the stamping knife is the upside or the downside of the sheet) is greatly related to preventing of print defects and cutting sharpness at the stamped portion, and it is common practice that either one of them is sacrificed depending upon the method selected by the machine manufacturer. That is, cutting sharpness is excellent on the anvil side face of the sheet, but on the contrary, print defects are liable to occur on the anvil side face.

In the above-described hand-hole die cutting device of the corrugated cardboard sheet box-making machine, in the case where it is intended to change the stamping method, that is, to change to the upside stamping method or to the downside stamping method, it is necessary to remount the entire device including the knife mount base q and the anvil mount base s. In the case of remounting the entire device as described above, due to the heavy weight of the mount bases and the like, remounting has been a difficult operation. In addition, since a slot cutting device of either an electromechanical setting type or an automatic setting type is mounted on the same shafts, in the case of mounting a manual type stamping device, the automatic setting operation for a slot cutting device becomes impossible. Thus, productivity is deteriorated due to the time required for setting. Furthermore, such an arrangement sometimes caused a breakdown due to a collision between parts within the machine, such as when an automatic setting is attempted while the stamping device is still mounted.

The present invention has been proposed for the purpose of eliminating the above-mentioned shortcomings of the prior art, and it is one object of the present invention to provide a novel stamping device in which component parts can be easily replaced according to the importance of the qualities of the products (i.e. printing or cutting sharpness). The device according to the present invention allows the setting time to be reduced which improves productivity. Furthermore, automation can be achieved which contributes to improvements in productivity by eliminating breakdown and reducing the time the operation is shutdown.

In order to achieve the aforementioned object, according to one feature of the present device, there is provided a novel stamping device in which at least one pair of common mount bases of the same shape and the same dimension for mounting a knife or an anvil are disposed on each of two shafts, so that either one of a knife and an anvil can be selectively remounted on the respective shafts.

According to the present invention, since the mount bases for the knife and the anvil are each formed in a common shape, there is a reduction in the number of component parts to be replaced, replacement can be achieved simply and easily, reduction in weight can be realized, also they can be formed as separate units, automatic setting is possible, and productivity can be improved by shortening the setting time.

BRIEF DESCRIPTION OF THE DRAWINGS

The above-mentioned and other objects, features and advantages of the present invention will become more apparent by reference to the following description of a preferred embodiment of the invention taken in conjunction with the accompanying drawings, wherein.

DETAILED DESCRIPTION OF THE PREFERRED EMBODIMENT

Figure 6:
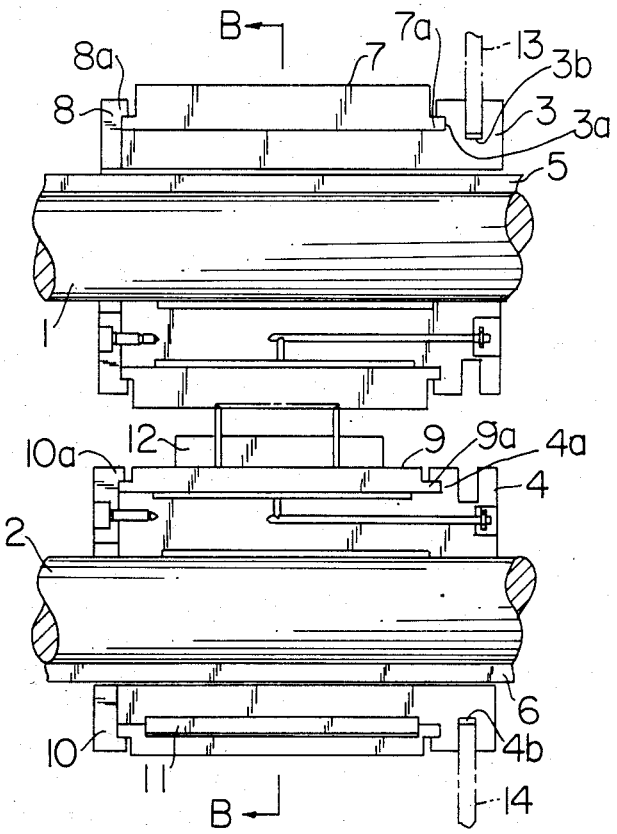
FIG. 6 is a front view of a stamping device according to one preferred embodiment of the present invention.
Figure 7:
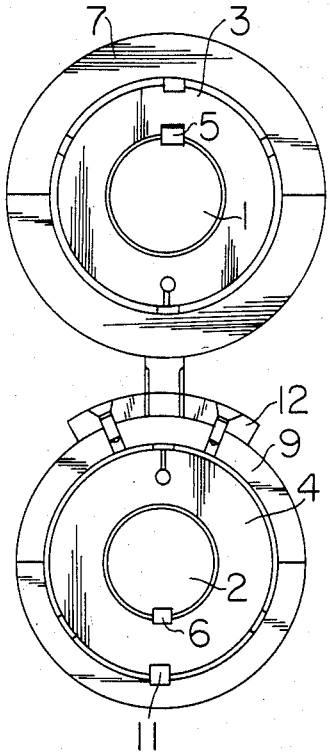
FIG. 7 is a cross-section view of the same device taken along line B—B in FIG. 6 as viewed in the direction of arrows.

Referring now to FIGS. 6 and 7, on upper and lower drive shafts 1 and 2 are respectively provided a one-piece cylindrical upper mount base 3 and a one-piece cylindrical lower mount base 4. The mount bases and the shafts are separated by a gap clearance for making the mount bases slidable along the respective drive shafts. In addition, keys 5 and 6 for transmitting torque to the upper and lower mount bases 3 and 4, respectively, are fixedly secured to the upper and lower drive shafts 1 and 2. The upper and lower mount bases 3 and 4 have exactly the same shape and the same dimension, and component parts to be mounted on these mount bases 3 and 4 have a configuration such that they can be mounted to either one of the upper and lower mount bases 3 and 4. However, in this specification, description will be made, by way of example, to the downside stamping method in which the knife is mounted on the downside of the sheet.

To the upper mount base 3 is mounted an anvil 7 having a two-section structure by means of a a circumferential axially extending slot 3*a* in a radially outwardly extending flange at one end of the upper mount base 3 for receiving an end 7*a* of the anvil 7 and a retaining plate 8 bolted to the opposite end of the upper mount base 3. The anvil 7 has a structure such that after it has been mounted to the upper mount base 3 a mechanically appropriate gap clearance may be formed therebetween, and so, during an operation, since a key is not provided between the anvil 7 and the upper mount base 3 the anvil 7 revolves by itself gradually due to a component force exerted thereupon when the sheet is being cut. In addition, onto the lower mount base 4 is fixedly secured a knife base 9 having threaded holes on its outer circumference by means of a circumferentially axially extending slot 4*a* in a radially outwardly extending flange at one end of the lower base 4 for receiving an end 9*a* of the knife base 9 a retaining plate 10 and a key 11 which is fixed in respective slots in the knife base 9 and the lower mount base 4. It is to be noted that the retaining plates 8 and 10 have axially extending shoulder portions 8*a*, 10*a* respectively for holding the anvil 7 and knife base 9 in position on the mount bases 3 and 4, respectively, and are formed in the same shape and the same dimension, and so, they are commonly available component parts. Furthermore, a cutting tool, such as a stamping knife 12, which is integrally connected to a mount base (normally made of a curved plywood) that is preliminarily shaped in a predetermined dimension, is mounted to the outer circumference of the knife base 9.

Figure 1:
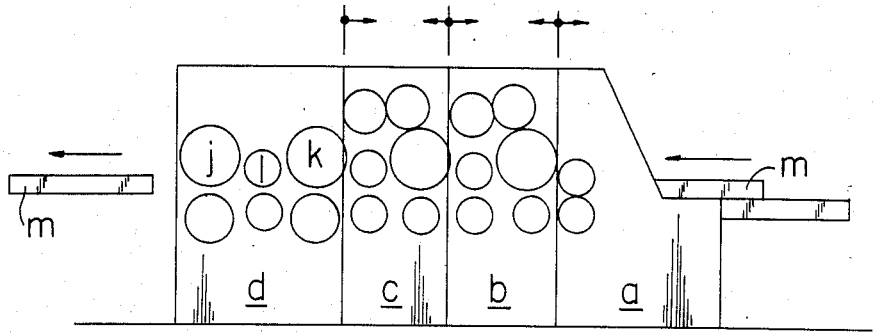
FIG. 1 PRIOR ART
FIG. 1 is a side view showing the outline of a corrugated cardboard box-making machine of the prior art.
Figure 2:
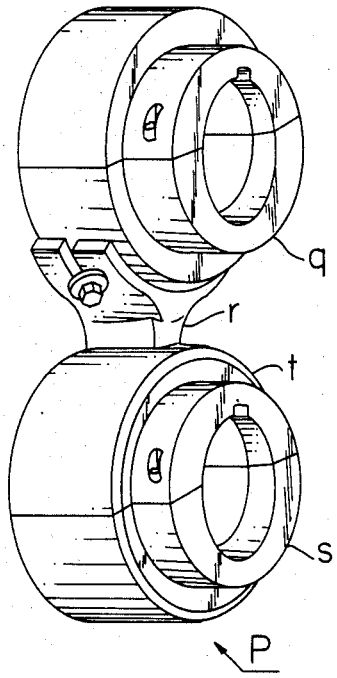
FIG. 2 PRIOR ART
FIG. 2 is a perspective view of a hand-hole cutting device of the prior art.
Figure 3:
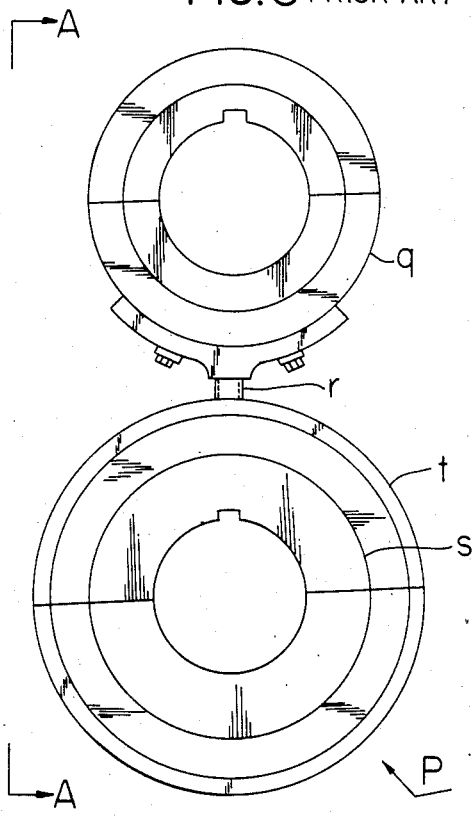
FIG. 3 PRIOR ART
FIG. 3 is a side view of the same device.
Figure 4:
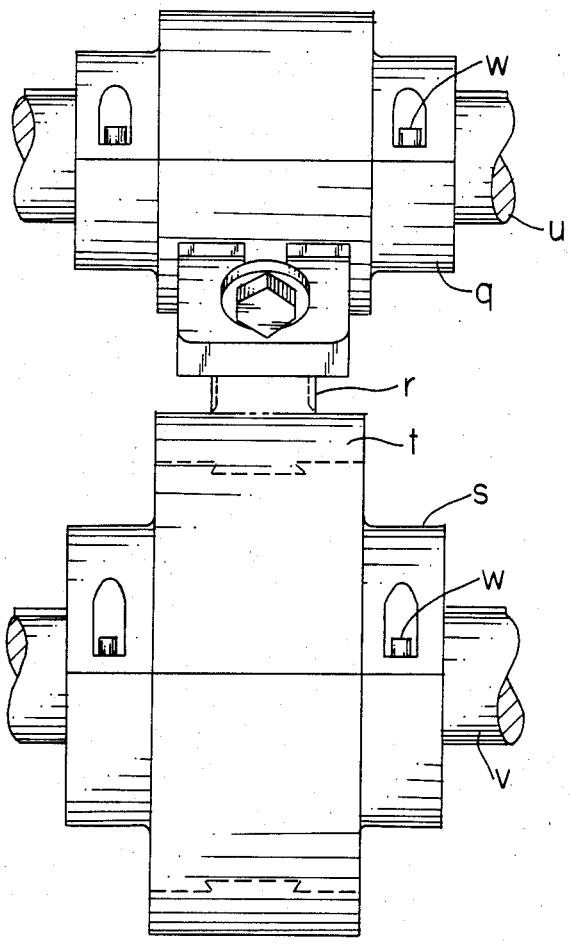
FIG. 4 PRIOR ART
FIG. 4 is a front view taken along line A—A in FIG. 3 as viewed in the direction of arrows.
Figure 8:
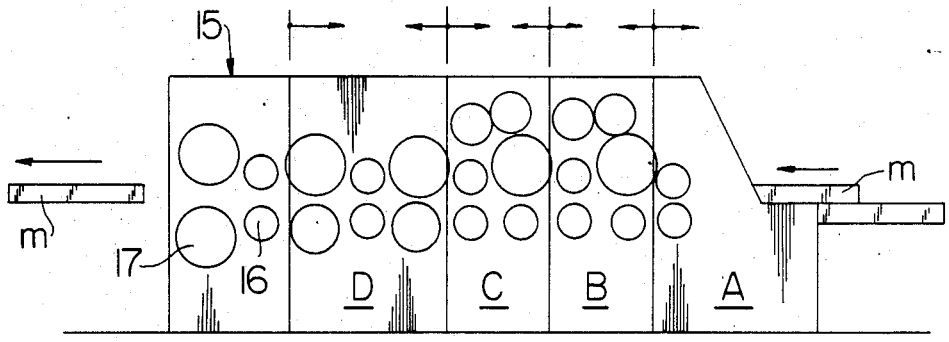
FIG. 8 is a side view showing the outline of a corrugated cardboard box-making machine provided with a stamping device according to the preferred embodiment of the present invention.

This stamping device is provided in one or more upper and lower pairs on the same drive shafts, and positioning in the widthwise direction can be set by means of an interlocking device coupled to yoke plates 13 and 14 each of which is received in a respective radially extending circumferential slot 3*b* and 4*b* in the upper mount base 3 and the lower mount base 4 (illustration and description of the interlocking device is omitted because any known method can be employed without objection). Also, adjustment of the gap clearance between the upper or lower anvil 7 and the edge of the knife 12 can be made so as to have a proper value of the gap clearance by means of a separate gap clearance regulating device (since any known regulating device is satisfactorily available, illustration and description of the device is omitted). FIG. 8 shows an arrangement in which a die cutting section 15 including a stamping device according to one preferred embodiment of the present invention, is additionally provided in the corrugated cardboard box-making machine in the prior art shown in FIG. 1. The shaft array in the die cut section 15 is such that feed shafts 16 and die cut shafts 17 are disposed in that sequence from the paper sheet feed side.

Figure 5:
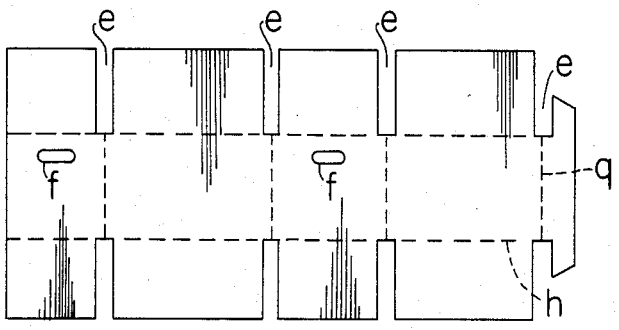
FIG.5 PRIOR ART
FIG. 5 is a plan view of a worked corrugated cardboard sheet.

Now explaining the operation, as shown in FIG. 8, a sheet m is fed from a paper sheet feed section A similarly to the box-making machine in the prior art, then passes through print sections B and C and a paper sheet eject section D, and in the final processing section it passes through the section including the die cutting shafts 17, where the die cutting device according to the present invention is disposed, to be processed into a finished sheet as shown in FIG. 5. Normally, if processing of stamped wastes and the like are taken into consideration, it is preferable to dispose the die cutting device in a section behind the paper sheet eject section D.

When the hand-holes f in FIG. 5 are cut, generally it is preferred that a cutting edge of a hole on the front surface of a sheet be perfectly formed, and so, an anvil 7 is disposed on the front surface side of the sheet (on the upper shaft) while a knife 12 is disposed on the rear surface side of the sheet (on the lower shaft) as shown in FIGS. 6 and 7. However, since the anvil 7 employs a free wheel system (since there is no key between anvil 7 and upper mount base 3) and hence it automatically revolves by itself during the operation, if the ink of a print pattern printed on the front surface of the sheet has not yet dried, the ink would be transferred onto the surface of the anvil 7, and the transferred ink is again transferred onto the front surface of the next sheet. Consequently, ink would adhere onto the front surface portion of the sheet other than the print pattern portion, and thus printing defects of the sheet would arise.

Accordingly, sometimes it is desired to dispose the knife 12 on the front surface side of the sheet (on the upper shaft) even though the cutting edge may present somewhat of a bad appearance. Therefore, if necessary, to interchange the upper and lower mount positions and dispose the knife 12 on the upper side and the anvil 7 on the down side by removing the retaining plate 8 to demount the anvil 7, and further removing the retaining plate 10 to demount the knife base 9 and the key 11. As described above, regardless of the front or rear surface of the sheet, the direction of stamping can be changed within a short period each time it is desired. Furthermore, owing to the fact that the die cutting section 15 is disposed separately and it is made possible to be connected to an interlocking device of the yoke plates 13 and 14, it becomes possible to set the die cutting section 15 individually and independently of the setting of the paper sheet feed section D, and as it is possible to set the die cutting section 15 within a short period.

Since the stamping device according to the present invention is constructed as described in detail above, the direction of stamping can be arbitrarily selected, and always the best quality of the products can be obtained. Moreover, it is possible to change the direction of stamping with ease within a short period of time, thus improvements in a productivity can be achieved, and automatic setting becomes possible by making it possible to dispose the die cutting section as a separate unit. Thus, the present invention can achieve very excellent effects such as saving of labor, improvements in productivity and the like.

While the principle of the present invention has been described above in connection to a preferred embodiment of the invention, it is intended that all matter contained in the above specification and illustrated in the accompanying drawings shall be interpreted to be illustrative and not in a limiting sense.

What is claimed is:

1. A stamping device for cutting holes in paper sheet such as corrugated cardboard, comprising:

a pair of identically shaped mount bases, each of which is slidably mounted on a respective rotatable upper and lower shaft, each of said mount bases having the same dimensions and being of one-piece cylindrical construction and fixed to said respective shaft for rotation therewith, each of said mount bases having means thereon for adjusting the position of said mount bases along said respective shaft;

an anvil and a knife base both of which are interchangeably mounted on said mount bases;

said anvil slidably disposed on one of said mount bases, said anvil being freely rotatable with respect to said one mount base;

said knife base slidably disposed on the other of said mount bases, means fixing said knife base to said other mount base for rotation therewith, said knife base having a cutting tool disposed thereon; and a pair of identically shaped retaining plates, each of said retaining plates being fixed to a respective one of said mount bases, one of said retaining plates engaging said anvil for positioning said freely rotatable anvil on said one of said mount bases, the other of said retaining plates engaging said knife base for positioning said knife base on said other mount base.

2. The stamping device of claim 1, wherein said means fixing said knife base to said other mount base comprises a key which is fitted in respective slots in said knife base and said other mount base.

3. The stamping device of claim 1, wherein each of said mount bases includes a radially outwardly extending flange at one end thereof, said flange having a circumferential axially extending slot, said slot in said one mount base receiving an end of said anvil and said slot in said other mount base receiving an end of said knife base.

4. The stamping device of claim 3, wherein each of said retaining plates includes an axially extending shoulder portion, said shoulder portion on said one retaining plate engaging the other end of said anvil and said shoulder portion of said other retaining plate engaging the other end of said knife base.

5. The stamping device of claim 1, wherein said means for adjusting the position of said mount bases along said upper shaft and said lower shaft includes a pair of yoke plates, each of said yoke plates being received in a respective radially extending circumferential slot in each of said mount bases.

6. A stamping device for cutting holes in paper sheet such as corrugated cardboard, comprising:

a pair of identically shaped mount bases, each of which is slidably mounted on a respective rotatable upper and lower shaft, each of said mount bases having the same dimensions and being of a one-piece cylindrical construction and fixed to said respective shaft for rotation therewith, each of said mount bases having means thereon for adjusting the position of said mount bases along said respective shaft, each of said mount bases including a radially outwardly extending flange at one end thereof, said flange having a circumferential axially extending slot;

an anvil and a knife base both of which are interchangeably mounted on said mount bases;

said anvil slidably disposed on one of said mount bases with an end of said anvil received in said slot in said one mount base, said anvil being freely rotatable with respect to said one mount base;

said knife base slidably disposed on the other of said mount bases with an end of said knife received in said slot in said other mount base, means fixing said knife base to said other mount base for rotation therewith, said knife base having a cutting tool disposed thereon; and means for positioning said freely rotatable anvil on said one mount base and means for positioning said knife base on said other mount base.

7. A stamping device for cutting holes in paper sheet such as corrugated cardboard, comprising:

a pair of identically shaped mount bases, each of which is slidably mounted on a respective rotatable upper and lower shaft, each of said mount bases having the same dimensions and being of a one-piece cylindrical construction and fixed to said respective shaft for rotation therewith, each of said mount bases having means thereon for adjusting the position of said mount bases along said respective shaft;

an anvil and a knife base both of which are interchangeably mounted on said mount bases;

said anvil slidably disposed on one of said mount bases, said anvil being freely rotatable with respect to said one mount base;

said knife base slidably disposed on the other of said mount bases, means fixing said knife base to said other mount base for rotation therewith, said knife base having a cutting tool disposed thereon; and means for positioning said freely rotatable anvil on said one mount base and means for positioning said knife base on said other mount base, said means for positioning said anvil and said knife base comprising a pair of identically shaped retaining plates, each of said retaining plates being fixed to a respective one of said mount bases, one of said retaining plates engaging said anvil for positioning said freely rotatable anvil on said one of said mount bases, the other of said retaining plates engaging said knife base for positioning said knife base on said other mount base, each of said retaining plates including an axially extending shoulder portion, said shoulder portion on said one retaining plate engaging an end of said anvil and said shoulder portion of said other retaining plate engaging an end of said knife base.

* * * * *